United States Patent [19]

Cookson

[11] 4,250,362

[45] Feb. 10, 1981

[54] CIRCUIT INTERRUPTER UTILIZING A CLOSING RESISTANCE

[75] Inventor: Alan H. Cookson, Southboro, Mass.

[73] Assignee: Westinghouse Electric Corp., Pittsburgh, Pa.

[21] Appl. No.: 967,830

[22] Filed: Dec. 8, 1978

[51] Int. Cl.[3] ..... H01H 33/16

[52] U.S. Cl. ..... 200/144 AP; 200/146 R; 200/148 R; 200/325

[58] Field of Search ..... 200/144 AP, 146, 148 R, 200/148 A, 153 P, 325

[56] References Cited

U.S. PATENT DOCUMENTS

| | | | |
|---|---|---|---|
| 3,291,947 | 12/1966 | Van Sickle | 200/148 R |
| 4,072,836 | 2/1978 | Bischofberger et al. | 200/144 AP |

*Primary Examiner*—James R. Scott

*Attorney, Agent, or Firm*—M. S. Yatsko

[57] ABSTRACT

A circuit interrupter for energizing a line includes stationary and movable main contacts, and stationary and movable impedance contacts which are used for inserting a resistance into the circuit upon closing. The movable impedance contact is rotatable with a projection extending outwardly therefrom, which projection, as the movable impedance contact moves towards the stationary impedance contacts, creates a non-uniform electric field distribution between the two impedance contacts. This distribution is especially useful in obtaining coordination between resistor insertion of multiple-interrupting-unit circuit interrupters. The movable impedance contact separates from the stationary impedance contact prior to separation of the main movable contact and the stationary main contact means during the opening operation.

6 Claims, 11 Drawing Figures

CIRCUIT INTERRUPTER UTILIZING A CLOSING RESISTANCE

BACKGROUND OF THE INVENTION

This invention relates generally to circuit interrupters, and more particularly to a high voltage circuit interrupter which uses a projection on a rotatable movable impedance contact to provide a non-uniform electric field distribution when the impedance contacts are moving toward the closed position.

It is known that high voltage surges, depending upon circuit conditions, can occur during the closing of the contacts of a high voltage circuit interrupter. One method of reducing the lever of such high switching surges is described in U.S. Pat. No. 3,291,947, where a resistance is inserted into the circuits of the circuit interrupter prior to the time of engagement between the main contacts. U.S. Pat. No. 4,072,836 also discloses the use of a resistor inserted into the circuit during the closing operation of a high voltage circuit interrupter.

When interrupting very high voltages, for example 500 kV, it is not uncommon to utilize two or more individual interrupting heads serially connected to provide the necessary interrupting distances. This use of multiple interrupting heads can cause coordination problems, particularly with respect to closing on an energized transmission line. This is particularly critical for the insertion of the resistors into the circuit. For correct operation of the resistor insertion scheme, it is essential that the impedance contacts within all the interrupting units close within a couple of microseconds. In practice, the gaps between the impedance contacts can be mechanically aligned this closely only with great difficulty, and sparking and breakdown between other gaps is not unusual. Thus, it would be desirable to eliminate the necessity of such a precise interconnection between the resistor insertion contacts without increasing the probability of sparking and breakdown.

BRIEF SUMMARY OF THE INVENTION

In accordance with this invention, a circuit interrupter for energizing a line is provided which includes stationary and movable main contacts operable between open and closed positions with respect to each other. A stationary impedance contact is electrically connected to the stationary main contact, and a movable, rotatable impedance contact is electrically connected to the movable main contact. The stationary and movable impedance contacts are utilized for inserting a resistance into the circuit prior to the closing of the main contacts. The movable impedance contact has a projection extending outwardly therefrom, with the projection extending into the electrical field between the movable and stationary impedance contacts whenever the movable impedance contact operates towards the closed position with respect to the stationary impedance contact. The projection causes the electric field distribution between the stationary and movable impedance contacts to become non-uniform, thereby increasing the probability of sparking and breakdown. This improves the coordination of the resistor insertions between several heads of the circuit breaker.

BRIEF DESCRIPTION OF THE DRAWINGS

Reference is made to the description of the preferred embodiments, illustrated in accompanying drawings, in which.

DESCRIPTION OF THE PREFERRED EMBODIMENTS

Figure 1:
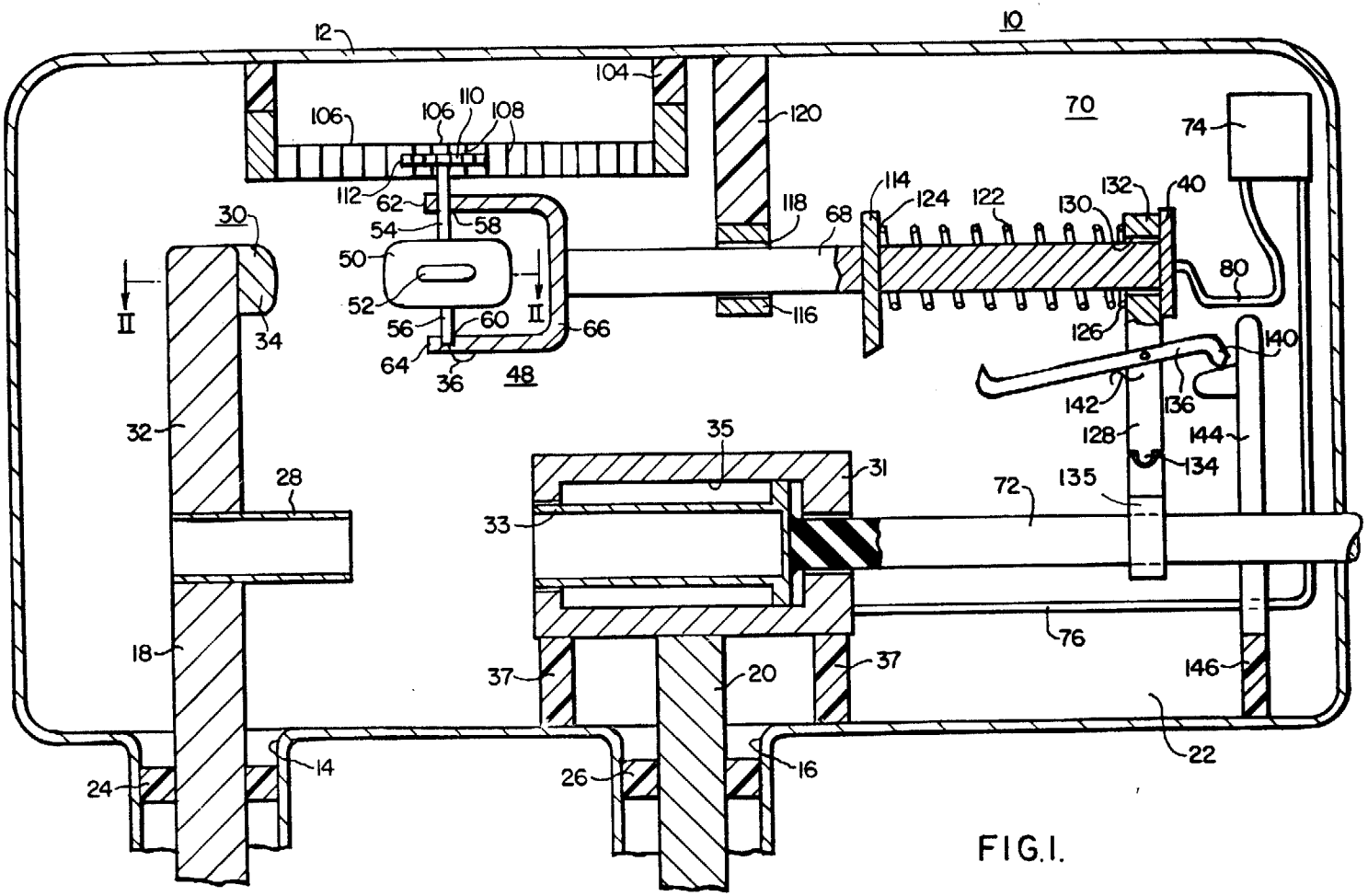
FIG. 1 is a view, partly in section and partly in elevation, of a circuit interrupter according to the teachings of this invention.

FIG. 1 illustrates a circuit interrupter according to the teachings of this invention. The interrupter 10 of FIG. 1 may be the sole interrupting unit, or a plurality of like interrupters 10 may be serially connected to interrupt extra high voltages. The interrupter 10 comprises a metallic enclosure 12 having a pair of spaced apart openings 14, 16 therein. Disposed in the openings 14, 16 are electrical conductors 18, 20 between which current flow is to be interrupted or connected. If so desired, a pressurized insulating gas 22, typical of which is pressurized sulfur hexafluoride, may be utilized within the enclosure 12 to provide a high dielectric insulation between the various elements. Preferably, support insulators 24, 26 are utilized for supporting the conductors 18, 20, respectively, and for prohibiting the escape of the insulating gas 22 through the openings 14, 16.

Electrically connected to the conductor 18 are stationary main contact means 28, and the stationary impedance contact means 30. Electrically connected to the conductor 20 is the metallic, electrically conducting contact member 31, which also functions as a guide for the movable main contact 33. The contact member 31 is cylindrical, having a bore 35 therein, with the movable main contact 33 being reciprocally slidable within the bore 35 while remaining in electrical contact with the contact member 31.

When the movable contact 33 is in the closed position with respect to the stationary main contact 28, electrical connection is made between the electrical conductors 18, 20, with the current flowing from the conductor 18 through the stationary main contact 28, to the movable main contact 33 in electrical contact therewith, through the main contact member 31 to the electrical conductor 20. Insulating support members 37 are utilized for maintaining the spatial location of the main contact member 31.

The stationary impedance contact 30 comprises a support member 32 which is electrically and mechanically secured to the stationary main contact 28 and the electrical conductor 18, and an impedance contact block 34. Fixedly secured to the enclosure 12 through the insulating support members 102, 104 is a longitudinally-extending bar 106 having a plurality of gear teeth 108 thereon, whose function will hereinafter be described.

The movable impedance contact means 48, which is capable of both reciprocal and rotatable movement, comprises an electrically conducting member 50 of a shape such as to form a uniform electrical field distribution in the gap 82 between the member 50 and the contact block 34, for example, a sphere or, as illustrated, cylindrical, with an electrically conducting projection 52 extending outwardly therefrom. Fixedly secured to the member 50 are aligned rods 54, 56 which are disposed in openings 58, 60 in two arms 62, 64, respectively, of a forked operating member 66. The rods 54, 56 are capable of rotating within the openings 58, 60 while remaining in electrical contact with the electrically conducting arms 62, 64. If desired, a lead member 36 may be fixedly secured to the end of the rod 56 and the arm 64 to insure electrical contact therebetween. The rod 54 extends outwardly beyond the arm 62 and is fixedly secured to the center of the gear wheel 110. The teeth 112 of the gear wheel 110 cooperate with the teeth 108 of the bar 106 to impart rotational movement to the rod 54 and the movable impedance contact member 50. The operating member 66 is connected to an electrically-conducting member 68 which is part of the movement effecting means 70 for imparting movement to both the movable main contact 33 and the movable impedance contact 48. The movement effecting means 70 is fixedly secured to the movable contact 33 through the insulating rod 72. The conducting member 68 has a spring stop 114 fixedly secured thereto, and has an electrically-conducting end plate 40 fixed at the end thereof. Guide member 116, having a bore 118 therethrough, is utilized for guiding the longitudinal movement of the conducting member 68. The guide member 116 is secured to the enclosure 12 through the insulating support 120.

Disposed about the conducting member 68 is a compression spring 122, one end 124 of which abuts against the spring stop 114. The other end 126 of the spring 122 abuts against the connecting rod 128. The connecting rod 128 has an opening 130 adjacent one end 132 thereof, and the other end 134 of the connecting rod is secured to the inner connecting element 135 in a suitable manner, with the inner connecting element 135 itself being fixedly secured, by suitable means to the insulating rod 72. The conducting member 68 is disposed within, and slidable within, the connecting rod opening 130.

Pivotally secured to the connecting rod 128 is a latch member 136 having two projections 138, 140 extending therefrom. A spring 142 normally biases the latch member 136 in the clockwise direction. A latch release member 144 is secured to the enclosure 12 through the insulating support 146, and is spatially located adjacent to the connecting rod 128 when the movable contacts 33, 48 are in the fully-open position. In this position, the latch projection 140 is in contact with the latch release member 144, which has caused a counterclockwise rotation of the latch member 136.

The insulating rod 72 extends outwardly beyond the enclosure 12 to an operating mechanism (not shown) which is part of the movement effecting means and which is utilized for imparting longitudinal movement to the rods 72, 128 and the conducting member 68.

Also disposed within the enclosure 12 is a resistance 74 which is electrically secured, at one end thereof, to the main contact member 31 by means such as the connector 76. The other end of the resistance 74 is electrically connected to, for example, the electrically conducting end plate 40, which is secured to the end of the member 68, by means of the flexible connector 80. In this manner, the resistor 74 is connected from the electrical conductor 20 to the movable impedance contact 50 through the main contact member 31, the connector 76, the resistance 74, the flexible connector 80, the end plate 40, the member 68, the arm 64, and the rod 54.

Figure 2:
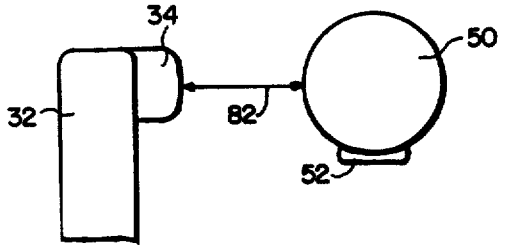
FIG. 2 is a side view of impedance contacts taken along line II—II of FIG. 1.
Figure 10:
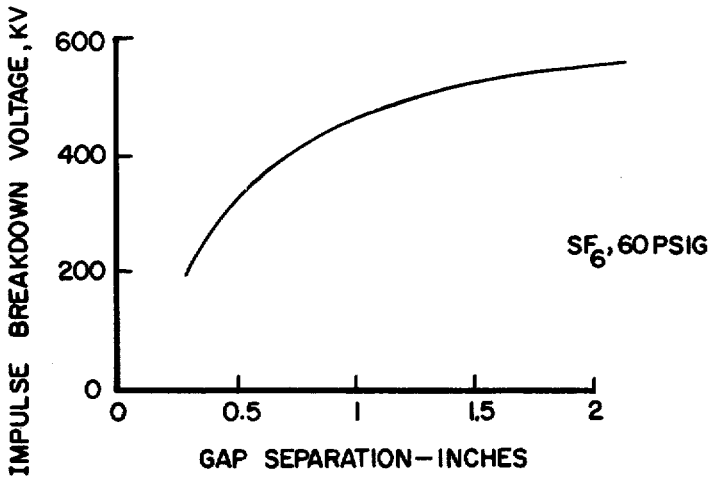
FIG. 10 is a graph illustrating the breakdown voltage characteristics between the impedance contacts when they are in the open position exhibiting a uniform field distribution.

Referring now to FIGS. 2–7, therein is illustrated the positions of the main and impedance contacts as they exist from open to closed positions. Referring now to FIGS. 1 and 2, it can be seen that both the impedance contacts 30, 48 and the main contacts 28, 33 are in the fully open position. The movable impedance contact 50 and the stationary contact block 34 form a gap 82 therebetween, which, because of the design of the member 50, forms a uniform electric field distribution therein. As can be seen from FIG. 10, this uniform field distribution has a breakdown voltage which varies considerably with the gap separation. Therefore, if this uniform field distribution were to remain constant, as the movable impedance contact 48 moves toward the contact block 34, the voltage at which breakdown would occur would decrease rapidly. To avoid this problem, the projection 52 on the member 50 is utilized to transform the electric field distribution in the gap 82 into a non-uniform distribution.

Figure 4:
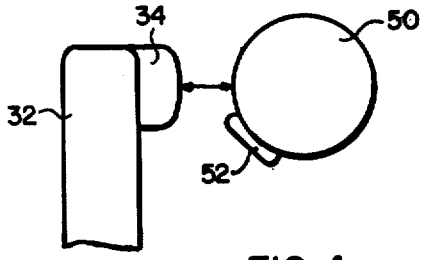
FIG. 4 is a side view of the impedance contacts taken along line IV—IV of FIG. 3.
Figure 3:
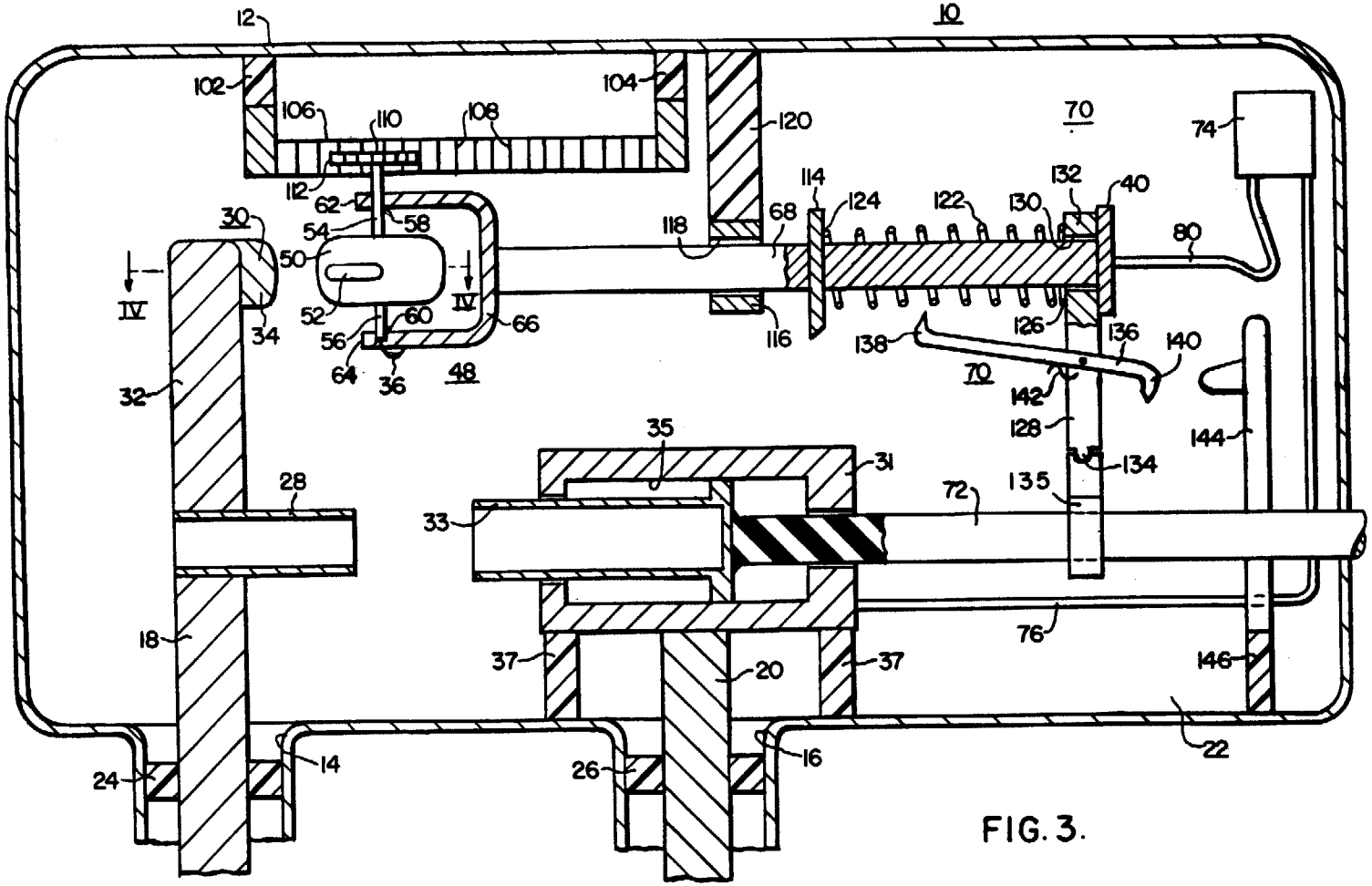
FIG. 3 is a view similar to FIG. 1 wherein the movable contacts are moving towards the stationary contacts.
Figure 11:
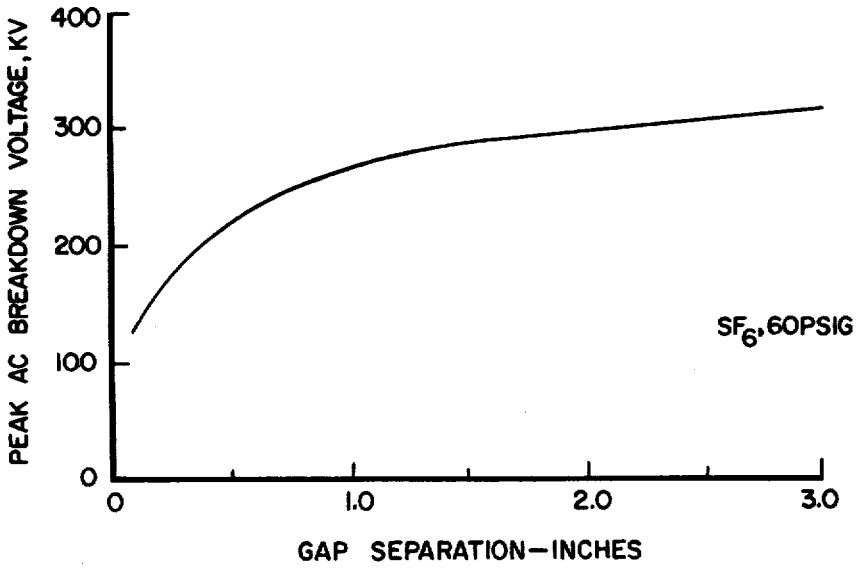
FIG. 11 is a graph illustrating the breakdown voltage characteristics of the impedance contacts when the projection causes a non-uniform field distribution.

As can be seen in FIGS. 3 and 4, as the movable impedance contact 48 moves longitudinally toward the stationary impedance contact 30, the movable impedance contact member 50 rotates so as to bring the projection 52 into a position where it extends into the electric field in the gap 82 to cause a disturbance thereof. This then results in a breakdown voltage characteristic as illustrated in FIG. 11, where it can be seen that major differences in the gap separation cause only slight decreases in the breakdown strength across the gap. Therefore, for use in circuit breakers having multiple interrupting units, minor differences in the resistor contact gaps have only a minor effect on the breakdown voltage, so that the gap in each interrupting unit breaks down within a small time delay of the breakdown in the other gaps.

The rotation and movement of the movable impedance contact 48 occurs simultaneously. As the insulating rod 72 is moved towards the closed position, leftward in the FIGS., the connecting rod 128 likewise is moved leftward. The connecting rod 128 contacts the spring 122 and exerts a leftward-directed force upon it, and the spring 122 in turn exerts this force against the spring stop 114. Not being otherwise restrained, this force causes a leftward movement of the member 68. The movement of the member 68 causes a corresponding movement of the arms 62, 64, the rod 54, and the gear wheel 110. This longitudinal movement of the gear wheel 110 causes its gear teeth 112 to cooperate with the gear teeth 108 on the bar 106, resulting in rotation of the gear wheel 110, the rod 54 and the member 50 which are secured thereto and rotation of the movable impedance contact member 50 causes a rotation of the projection 52 which extends outwardly therefrom.

As can be seen in FIGS. 3 and 4, the member 50 has moved toward the contact block 34 approximately half the original, open-position distance therebetween. The projection 52 has rotated about the axis formed by the aligned rods 54, 56 approximately 45°. Also to be noted is that the latch projection 140 has moved away from the latch release member 144 so that the latch member 136 is now biased by the spring 142 in the clockwise position.

Figure 6:
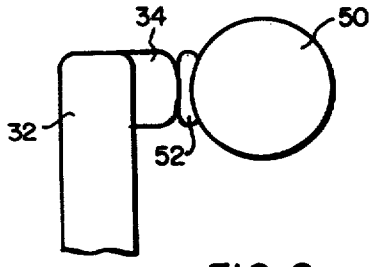
FIG. 6 is a side view of the impedance contacts taken along line VI—VI of FIG. 5.
Figure 5:
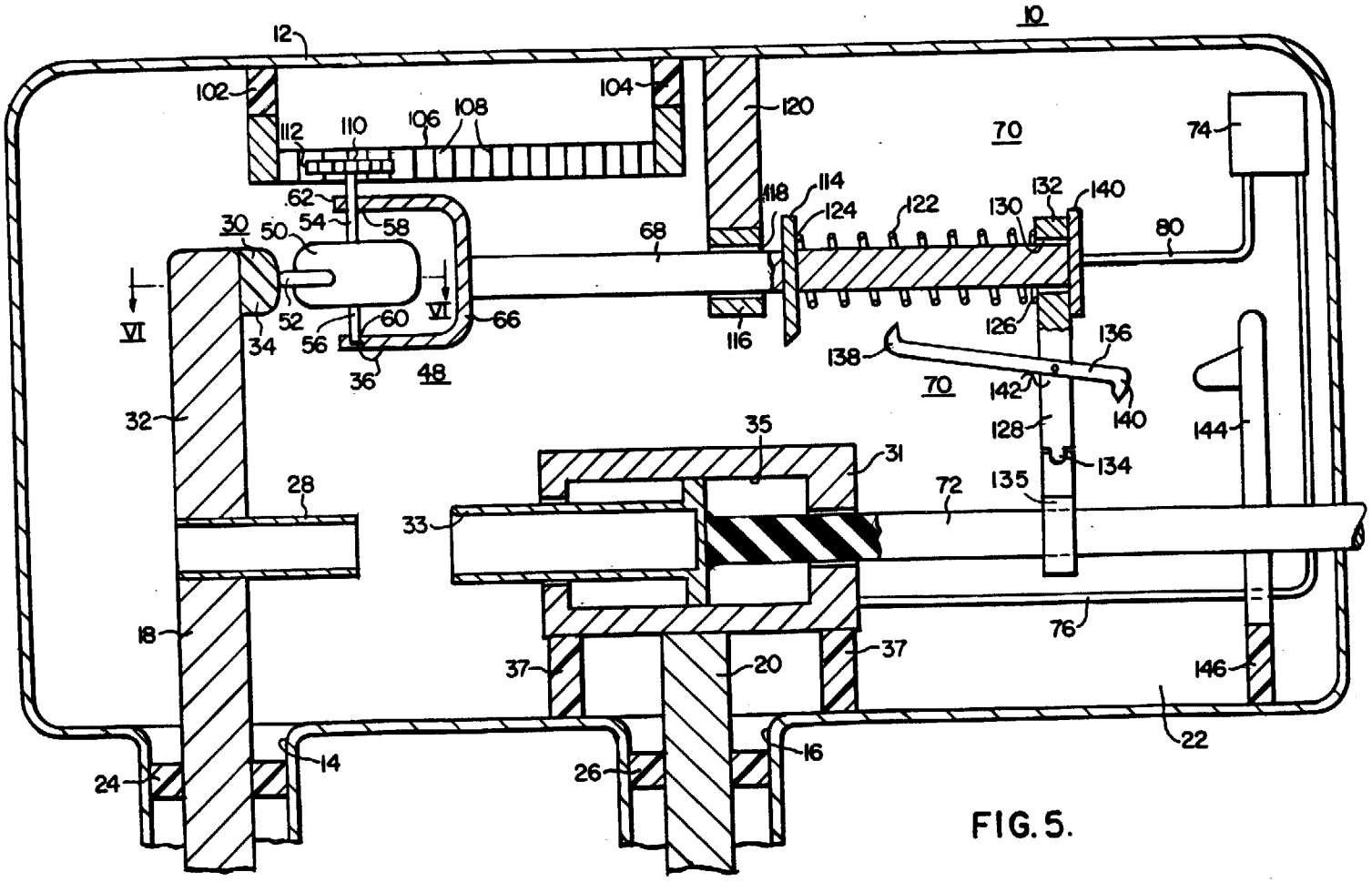
FIG. 5 is an illustration similar to FIG. 1, wherein the impedance contacts are in the closed position, and the main contacts have not yet been closed.

FIGS. 5 and 6 show the impedance contacts 48 and 30 in the closed position, while the main contacts 33 and 28 are still in an open position. As can be seen FIG. 6, the projection 52 of the member 50 has rotated 90° from its initial, open-position location, and contacts the contact block 34 to thereby effect closing of the impedance contacts. When this occurs, which is prior to the closing of the main contacts 28, 33, a current path exists between the electrical conductors 20 and 18, which current path is through the resistance 74. The complete current path is as follows: from the electrical conductor 20 to the contact member 31, through the connector 76 to the resistance 74, from the resistance 74 through the electrical connector 80 to the end plate 40, to the member 68, to the arm 64 through the lead 36, to the rod 56 and the element 50 to the projection 52, from the projection 52 through the contact block 34, to the support 32, and from the support 32 to the electrical conductor 18.

Figure 7:
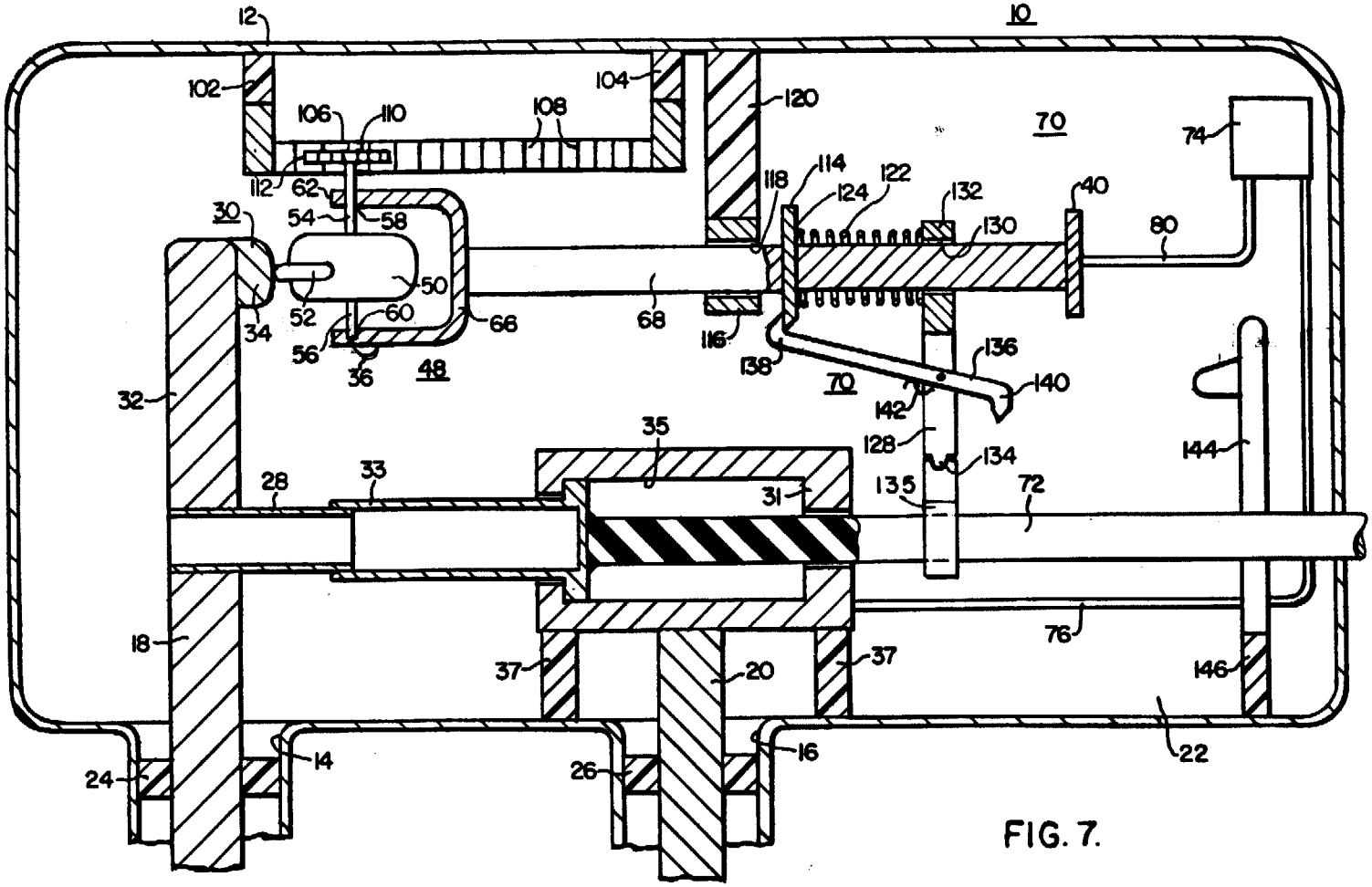
FIG. 7 is an illustration similar to FIG. 1, wherein both the main and impedance contacts are in the closed position.

As can be seen in FIG. 7, when the main contacts 33, 28 are in the closed position, the additional movement of the movable impedance contact 48 is compensated for by the compressing of the spring 122. When the main contacts 28, 33 are in the closed position, the latch projection 138 has moved into position behind the spring stop 114. When the main contacts 28, 33 are in the closed position, the electrical path between the conductors 18, 20 is through the main contacts 28, 33, thereby shorting out both the impedance contacts 48, 30, and the resistance 74.

Upon opening of the circuit interrupter 10, the movement effecting means 70 causes a rightward movement of the member 68 because of the force exerted by the latch member 136, and more particularly the latch projection 138, against the spring stop 114. Thus, the movable impedance contact 48 separates from the stationary impedance contact 30 prior to the separation of the main contacts 28, 33. As the movable contacts 33, 48 move to the fully-open position, the latch projection 140 engages the latch release member 144, causing a counterclockwise rotation of the latch member 136 and release of the spring stop 144, thereby positioning the elements for a closing operation.

Figure 9:
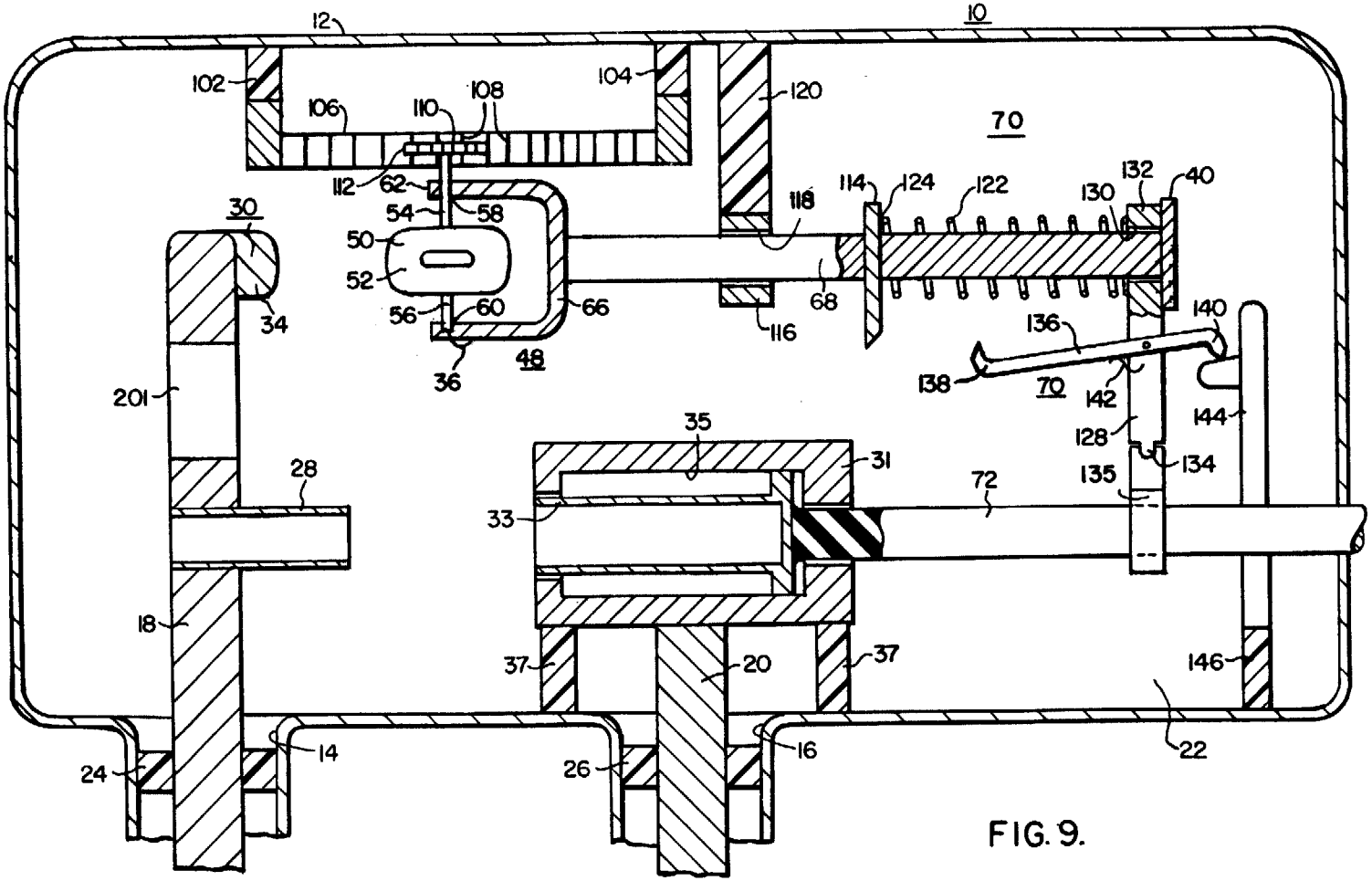

Referring now to FIG. 9, therein is illustrated a modification of the circuit interrupter 10 illustrated in FIG. 1. In this modification, all the elements are as previously described with respect to FIG. 1, except that the resistance 201 is now electrically connected between the stationary main contact 28 and the stationary impedance contact 30, being inserted into the circuit only whenever the movable impedance contact 48 is in electrical contact with the stationary impedance contact 30. The operation of the movable impedance contact 48 as it moves longitudinally and rotatably is identical to that heretofore described.

Figure 8:
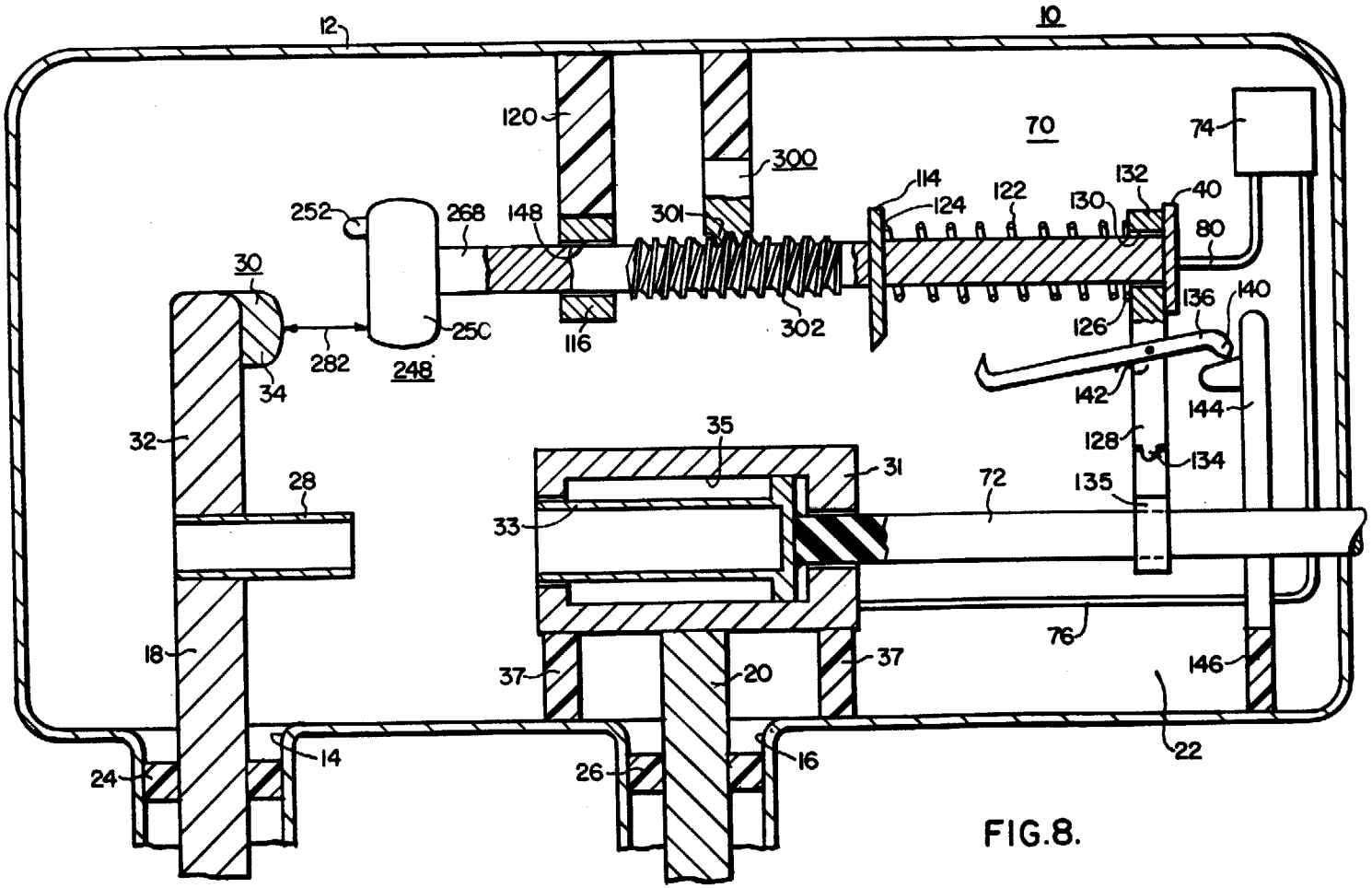
FIGS. 8 and 9 are modifications of the circuit interrupter illustrated in FIG. 1.

An additional modification to the circuit interrupter 10 illustrated in FIG. 1 is shown in FIG. 8. In this modification, the movable impedance contact member 250 is directly and fixedly secured to the electrically conducting member 268. The projection 252 still does not disturb the field distribution in the gap 282 until the contacts 248, 30 move towards the closed position, but in this modification, the rotation occurs at right angles to the field. A rotation-imparting element 300 is insulatedly secured to the enclosure 12, and has gear teeth 301 adjacent to the member 268. The member 268 has worm gear teeth 302 thereon which engage the gear teeth 301 and cause rotation of the member 268, the impedance contact member 250, and the projection 252 upon longitudinal movement of the electrically-conducting member 268. The operation of the other elements is as previously described.

I claim as my invention:

1. A circuit interrupter for energizing a line comprising:

stationary main contact means;

a movable main contact operable between open and closed positions with respect to said stationary main contact means;

means defining a stationary impedance contact electrically connected to said stationary main contact means;

a resistance electrically connected to said movable means contact;

a movable, rotatable impedance contact electrically connected to said resistance and operable between open and closed positions with respect to said stationary impedance contact, said movable impedance contact having a projection extending outwardly therefrom, said movable impedance contact and said stationary impedance contact, when in said open position, having a substantially uniform electric field distribution therebetween, said movable impedance contact, upon moving towards said closed position with respect to said stationary impedance contact, rotating and causing said projection to extend into the electric field between said stationary and movable impedance contacts causing said electric field distribution therebetween to become non-uniform; and movement effecting means for effecting movement of said movable main contact between said open and closed positions with respect to said stationary main contact means and for effecting rotation and movement of said movable impedance contact between said open and closed positions with respect to said stationary impedance contacts, said movement effecting means effecting movement of said movable impedance contact such that said movable impedance contact is in said closed position with respect to said stationary impedance contact prior to said movable main contact being in said closed position with respect to said stationary main contact means.

2. A circuit interrupter comprising:

stationary main contact means;

a movable main contact operable between open and closed positions with respect to said stationary main contact means;

means defining a stationary impedance contact electrically connected to said stationary main contact means through a resistance;

a movable, rotatable impedance contact operable between open and closed positions with respect to said stationary impedance contact, said movable impedance contact having a projection extending outwardly therefrom, said movable impedance contact and said stationary impedance contact, when in said open position, having a substantially uniform electric field distribution therebetween, said movable impedance contact, upon moving towards said closed position with respect to said stationary impedance contact, rotating and causing said projection to extend into the electric field between said stationary and movable impedance contacts causing said electric field distribution therebetween to become non-uniform; and movement effecting means for effecting movement of said movable main contact between said open and closed positions with respect to said stationary main contact means and for effecting rotation and movement of said movable impedance contact between said open and closed positions with respect to said stationary impedance contact, said movement effecting means effecting movement of said movable impedance contact such that said movable impedance contact is in said closed position with respect to said stationary impedance contact prior to said movable main contact being in said closed position with respect to said stationary main contact means.

3. The circuit interrupter according to claims 1 or 2 including an enclosure having disposed therein said stationary main contact means, said movable main contact, said stationary impedance contact, said resistance, said movable impedance contact, and said movement effecting means.

4. The circuit interrupter according to claim 3 including an insulating gas disposed within said enclosure.

5. The circuit interrupter according to claim 4 wherein said insulating gas is pressurized sulfur hexafluoride.

6. The circuit interrupter according to claims 1 or 2 including means causing the separation of said movable impedance contact from said stationary impedance contact prior to the separation of said movable main contact from said stationary main contact means during an opening operation.

* * * * *